United States Patent [19]

Manetti

[11] 4,046,087

[45] Sept. 6, 1977

[54] AUTOMATIC APPARATUS FOR CONJOINTLY SEWING TWO ELASTIC CLOTHS HAVING DIFFERENT ELASTICITY

[75] Inventor: Orlando Manetti, Valdobbiadene, Italy

[73] Assignee: Sigismondo Piva S.p.A., Milan, Italy

[21] Appl. No.: 565,948

[22] Filed: Apr. 7, 1975

[51] Int. Cl.[2] ..... D05B 21/00

[52] U.S. Cl. ..... 112/121.15; 112/121.26; 112/121.29; 112/211

[58] Field of Search ..... 112/121.15, 121.26, 112/121.27, 121.29, 207, 203, 211, 214, 212

[56] References Cited

U.S. PATENT DOCUMENTS

| | | | |
|---|---|---|---|
| 2,266,538 | 12/1941 | Evans | 112/121.26 |
| 2,630,773 | 3/1953 | Caprara et al. | 112/121.26 |
| 2,885,979 | 5/1959 | Perkins | 112/121.27 |
| 3,213,814 | 10/1965 | Boser | 112/121.15 X |
| 3,219,002 | 11/1965 | Levy | 112/121.26 |
| 3,500,779 | 3/1970 | Jones et al. | 112/121.15 X |
| 3,776,155 | 12/1973 | Gratsch | 112/121.15 |
| 3,865,058 | 2/1975 | Rovin et al. | 112/121.26 X |

*Primary Examiner*—George H. Krizmanich
*Attorney, Agent, or Firm*—Finnegan, Henderson, Farabow & Garrett

[57] ABSTRACT

An apparatus for automatically sewing together two elastic cloths having different elasticity, the less elastic of which has a substantially annular shape, comprises a conventional sewing machine having its rotating devices connected with supporting and feeding means of the two cloths to be joined together, such as at least two pulleys or a funnel-shaped member, or two pairs of grippers, in combination with a means for correctly positioning the cloths within the sewing zone, which is located at 20°–30° before the completion of the sewing cycle, ahead of the sewing machine needle. A suction-operated device conveys the sewed, assembled pieces to a conventional spreading and discharging device, from the openable bottom of which those pieces are caused to drop into a container. The supporting and feeding means will be of the stationary type or of the movable type, in the latter case being mounted on a platform for a step-by-step station of 360°/*n*, where *n* is the number of units of said supporting and feeding means. This applies when the cloth of higher elasticity has an annular shape; when on the contrary it is an elongated elastic band section it is necessary to sew together the two ends of the section. This can be accomplished either by an ancillary sewing machine and a conveying system for bringing the two ends under the head thereof, or by modifying the head of the main sewing machine so that it can move transversely at right angles with respect to the main sewing path of the two cloths.

10 Claims, 9 Drawing Figures

AUTOMATIC APPARATUS FOR CONJOINTLY SEWING TWO ELASTIC CLOTHS HAVING DIFFERENT ELASTICITY

BACKGROUND OF THE INVENTION

This invention relates to an automatic apparatus for conjointly sewing two elastic cloths having different elasticity and in particular for the sewing of an elastic cloth onto another elastic cloth having a lower elasticity and being of substantially annular shape. The most important application for such an apparatus is in the clothing field and particularly in the field relating to the manufacturing of corsets, underwears, slip-stockings (collants), bathing suits and the like.

For a better understanding of the present invention, with the term "cloth" it is meant any woven or knitted fabric (wool, silk, flax, synthetic fibers and the like), the elasticity of which depends on the own elasticity of the yarns or on the manufacturing method (i.e. weaving, knitting and similars). With the term "piece" it is meant any manufactured product formed by at least two conjointly sewed cloths to be possibly subjected to further operations.

It is known that a sewing of this type has been so far obtained by manually joining two elastic cloths by means of a conventional sewing machine, which has to be controlled by a single operator. The operator in order to obtain a good seam, has to manually transfer the two cloths to be joined under head of a sewing machine and has further to provide for maintaining the correct relative position of said joined cloths until the completion of the sewing cycle.

Attempts have been effected to partially eliminate the drawbacks due to such a manual work by providing several devices adapted to be applied to the head of the sewing machine in order to carry out at least a part of the manual work entrusted to the operator. Such devices usually comprise mechanical stress regulators, slides, supports and pressing shoes which assist the operator to whom however the task of carrying out the sewing operation is still entrusted and whose intervention is essential for obtaining a proper joint of the cloths.

From the above it results that the pieces thus obtained are costly if compared to the employed labour cost and scarcely reliable as to their quality. As a matter of fact, the time spent by a single operator excessively affects the production cost of the finished piece, and this without taking into account the considerable time spent for training the operator to that specific task, which task requires a good specialization. Moreover, the quality of the finished piece manufactured by the same operator may change from piece to piece and, in any case, it changes anytime the operator is changed.

SUMMARY OF THE INVENTION

It is an object of the present invention to provide an apparatus which fully automatically performs the sewing operation of an elastic cloth onto another cloth having a lower elasticity and of substantially annular conformation.

With the apparatus according to the invention the continuous intervention of the operator is no more necessary, to the same operator being left the task of controlling the operation of the apparatus, so that a specific specialization is no more required. The sewing operation is therefore faster and the seam of more uniform quality. Furthermore due to the automatism of the apparatus, a single operator may operate several apparatuses at the same time, by fully exploiting the working time of each sewing machine.

The apparatus according to the present invention, comprising a conventional sewing machine, is characterized in that said apparatus further comprises supporting and feeding means of the cloths to be joined on the working table of the sewing machine, said means being connected to rotating members of the same sewing machine; positioning means for locating said cloths within the sewing area; and discharging means for automatically discharging the sewed pieces.

BRIEF DESCRIPTION OF THE DRAWINGS

These objects, advantages and characteristics of the apparatus according to the present invention will become more apparent from the following description, given only by way of a non-limiting example, with reference to the annexed drawings, wherein.

DETAILED DESCRIPTION OF THE PREFERRED EMBODIMENTS

It is to be understood that with the apparatus according to the invention two different basic types of sewing operations can be carried out, namely:

1. sewing an elastic cloth having an annular shape(-thereinafter also referred to as "elastic band") onto another elastic cloth having a lower elasticity and a substantially annular-shaped contour; 2. sewing of an elongated section of an elastic band onto an elastic cloth having a lower elasticity and a substantially annular-shaped contour.

The first part of the following description relates to the first of the two above-cited cases. It should be noted however that said two types of sewing are very similar; as a matter of fact, the linear section of an elastic band of the second case is also closed to form a ring by an additional and further operation which is carried out after completion of the main sewing operation of the two cloths together.

It is a feature of the apparatus according to the invention to use, as sewing machine, a conventional sewing machine in the trade properly modified, thus allowing the automatization of the conventional sewing machine already used for such a type of sewing. The sewing machine, therefore will not be herein described in details, but only the sewing head and the related sewing devices thereof will be shown.

Figure 1:
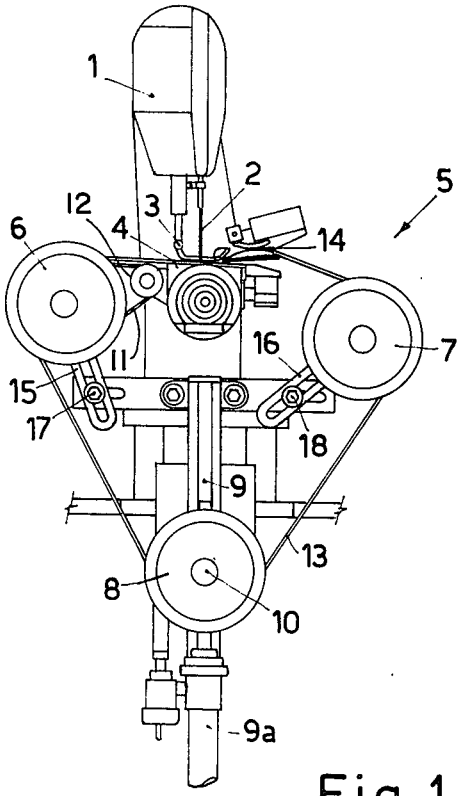
FIG. 1, is a diagrammatic view of the apparatus according to the invention provided with a first preferred embodiment to the cloth supporting and feeding means.

With particular reference to FIG. 1, the apparatus according to the present invention comprises a sewing machine of which only the sewing head 1 with the related needle 2 and the pressing shoe 3 acting on a working table 4 are shown. Near the sewing head 1 of the machine, supporting and feeding means 5 for the cloths to be jointly sewed are provided, said means comprising in this first embodiment shown, three pulleys 6, 7 and 8 each rotatably supported by its axis the three axes being positioned at the vertices of a triangle. One said pulleys i.e. pulley 8 in the embodiment shown, is movable, with respect to the other two pulleys so that the mutual distance of said three pulleys can be adjusted according to the diameter of the circumferential cloths to be sewed. It is thus obtained the adaptability of the apparatus to various possible sizes of the circular outline of the less elastic cloth and the self-adjusted stretching of the same.

The adjustement of the position of pulley 8 is obtained by locking in any conventional manner its rotational axis, a shaft 10, in different positions along a slide 9 fastened to the frame of the apparatus, for example by means of a pneumatic cilinder 9*a*. Otherwise the same pulley 8 may be adjusted by a spring urging said pulley 8 and its shaft 10 away from the other two pulleys. The axes of pulleys 6 and 7 are mounted on supports 15 and 16 which can be fastened in different positions on the frame of the apparatus by means of fastening screws 17, 18 and of slots formed in the same supports 15 and 16.

Figure 1A:
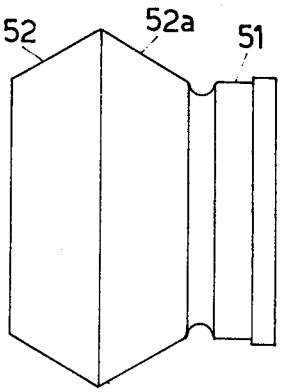
FIG. 1*a* is a side view of the contour of the pulleys being a part of the apparatus shown in FIG. 1.

Pulley 6 is connected by a belt 11 to a rotating member 12 of the sewing machine, thus being the driving pulley, while pulleys 7 and 8 are idle-supported and driven by a belt 13. Pulleys 6, 7 and 8 may be made of any desired material, such plastics, wood, iron or rubber, and they preferably have their profile shaped as shown in FIG. 1*a*, i.e. comprising a substantially plane portion 51 provided with grooves and a portion formed by two truncated cones 52 and 52*a* having the major base in common.

For the loading of the cloths on the supporting and feeding means 5, only the following operations have to be carried out: the elastic band is firstly positioned on the three pulleys, the adjustable one of which, indicated by reference numeral 8, is in its nearest position relative to the remaining two pulleys (highest position in FIG. 1) in order to facilitate the insertion of the same elastic band. Said elastic band is positioned not only on the peripheral zone of the pulleys (preferably at zone 51 of FIG. 1*a* conveniently shaped), but also on a positioning device 14 provided in the proximity of the sewing area, which positioning device will be better described further on. Subsequently, on the same three pulleys there is positioned the annularly shaped cloth of lower elasticity. Due to the particular conformation of the peripheral zones of the pulleys, in particular zone 52, the said less elastic cloth positions itself with its outer edge on the elastic band previously positioned. By operating the apparatus before starting the sewing machine, shaft 10 of pulley 8 is brought away, for example driven by pneumatic cylinder 9*a*, from the two other pulleys until it reaches an outwardly directed position which depends on the relative elasticity of the two cloths. Pulley 8 will therefore reach a position which is much far away from the center of the triangle formed by the three pulleys as higher is the elasticity of the two cloths to be jointly sewed, so that the resulting stretch at the sewing point will remain, within limited percentage allowances, as constant as possible for any stress to which the cloths are subjected.

The needle 2 of the sewing head 1 can thus be operated to start the sewing operation and the driving pulley 6, connected to the rotating members of the sewing machine, drives the two other pulleys 7 and 8 and therefore the two overlapped cloths to be sewed. At the end of a complete revolution of 360°, the sewing yarn is cut by a known cutting device of the same sewing machine and the sewed piece is automatically discharged by the automatic discharging means schematically shown in FIG. 8, according to the present invention.

Figure 7:
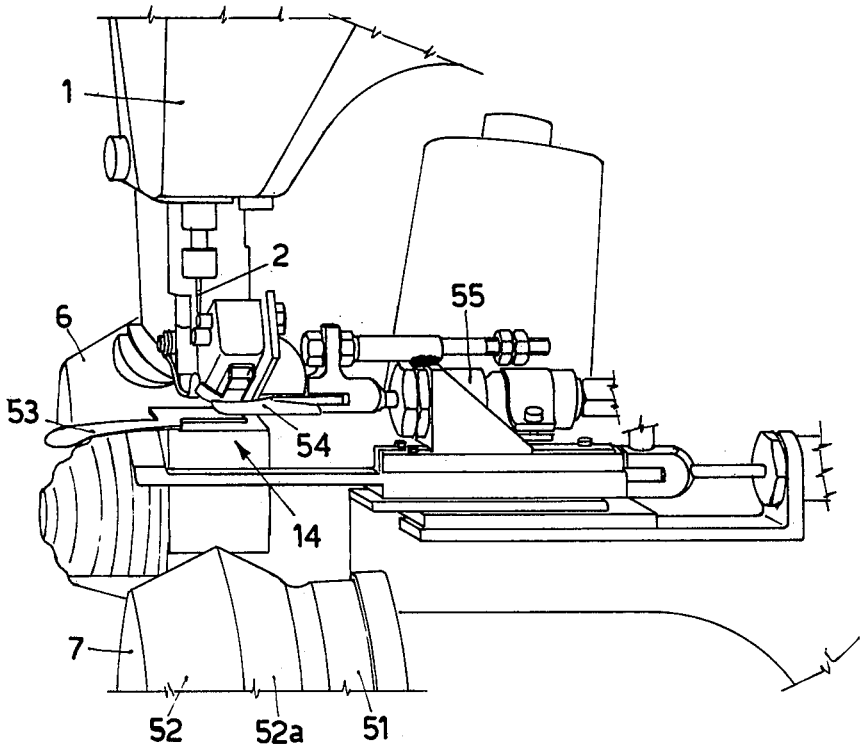
FIG. 7 diagrammatically shows an example of the means for positioning the cloths within the sewing area.

Before completion of the sewing cycle, i.e. during the last 20°–30° of rotation of the two cloths ahead of the sewing starting point, the sewing zone positioning device generically indicated with reference numeral 14 in FIGS. 1 and 7 is actuated. With particular reference to FIG. 7, said device 14 comprises a stationary plate slide 53 and an upper movable pressure shoe 54, which is slidable in the two opposite directions parallel to the rotation axes of pulleys 6, 7 and 8, i.e. perpendicularly to an ideal sewing plane, defined by the triangle formed by the same three pulleys. The stationary slide 53 supports during the sewing cycle the less elastic cloth, while the elastic band is supported at the proximity of the sewing point by the movable pressure shoe 54. Thus, during the sewing cycle up to about 20°14 30° before returning to the sewing starting point, the two cloths are separated in the zone of device 14 at a distance of about 5–6 cm. from needle 2. At the beginning of the last portion of the sewing cycle, shoe 54 is moved backwardly by conventional means such as microswitch to operate a pneumatic piston 55 connected to shoe 54, which is brought backward, to the inner side of the machine, thus freeing the elastic band. This is allowed to conjoint with no substantial stress the less elastic cloth to which is sewed during the last section (few mms) of the sewing cycle. The stretch previously accumulated due to the distance between slide 53 and upper shoe 54 is, in any case, so little as it is not sensed in said last portion of the sewing cycle. The upper movable shoe 54, which also can be driven by a spring or the like, is brought back to its initial position at the end of the 360° sewing cycle thus allowing the loading of a new piece, such as by means of pneumatic pistons or other known servo-mechanisms controlled by microswitches.

Figure 8:
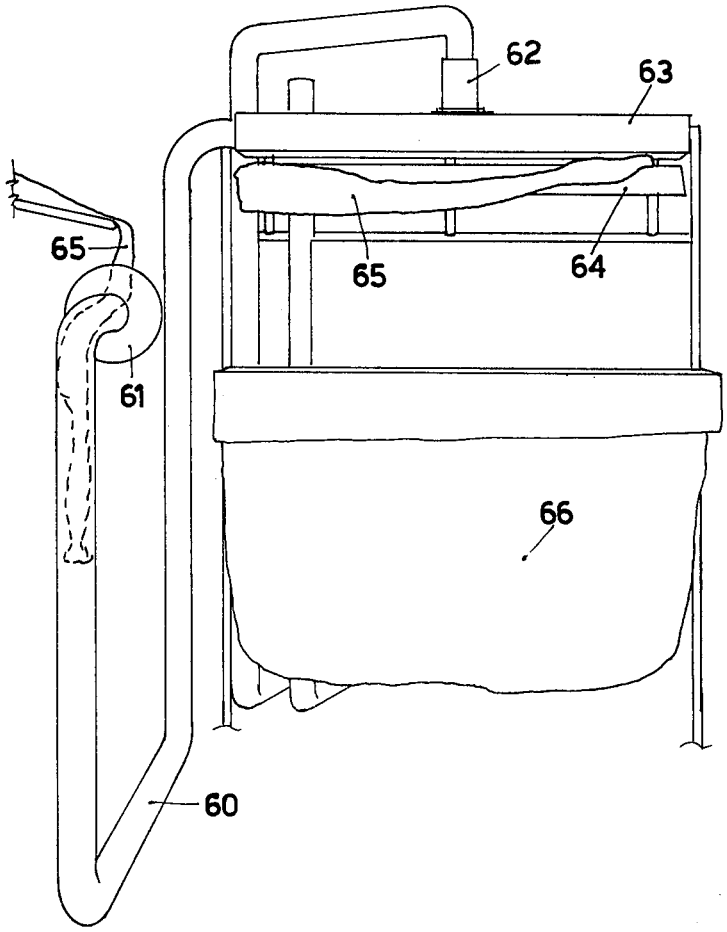
FIG 8. diagrammatically shows an example of the automatic discharging means of the finished pieces.

With reference to FIG. 8, a preferred embodiment of the automatic device for discharging the finished pieces at the completion of each sewing cycle, is shown. Said device substantially comprises a pipe 60 provided with a funnel-shaped inlet 61, positioned in proximity of the above described apparatus and kept constantly under vacuum by a suction fan 62. As soon as the cloths are positioned on the device 5 of FIG. 1, the free end of one of said cloths, in particular the free end of the less elastic cloth, is retained inside the funnel 61, but it cannot be sucked inside said pipe 60 since the other end of the same cloth is retained by pulleys 6, 7 and 8. It should be noted — and this is particularly valid in case of sewing of stockings and slip-stockings — that the funnel 61 may also be positioned at a certain distance from the device 5 and the sewing area, due to the particular length and lightness of the articles to be sewed. As soon as the sewing cycle has been completed, pulley 8 is brought back, advantageously by automatic means, in its initial position, i.e. closer to the two other pulleys, to slack the stretch onto the sewed end of the piece. Said slackening allows the suction within pipe 60 to such the finished piece and transfer the same into the spreading and discharging device 63. This device 63 comprises a box, advantageously of transparent material, the length of which corresponds to the length of the sewed pieces and the bottom 64 of which is movable and connected to a known servo-mechanism. When piece 65 is entering into the spreading and discharging device 63 a photoelectric cell circuit is closed and the atmospheric pressure inside the spreading device 63 restored — for example by means of a pneumatic piston and a fan — while usually the atmosphere within said device is maintained under a vacuum condition. In this situation and upon the complete spreading of the sewed piece along the bottom 64 of device 63, by means of known mechanical members (not shown), the above cited servo-mechanism opens said bottom 64 and piece 65 falls down into an underlying container 66. In FIG. 8 two pieces 65 have been shown, in this particular case two slip-stockings, of which the one already sewed is in position to fall down from device 63 into container 66 and the other one, still undergoing the sewing operation, is partially retained by the suction inside the funnel 61 and pipe 60.

Figure 2:
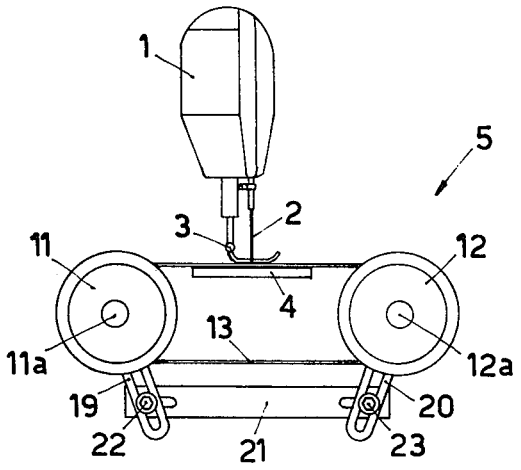
FIGS. 2, 3 and 4 diagrammatically show the apparatus according to the invention, provided with further embodiments of the cloth supporting and feeding means.

So far, reference has always been made, in so far as it is concerned with the supporting and feeding means for the cloths to be sewed, to the three-pulley device shown in FIG. 1, but obviously different embodiments can be provided for the device 5. Said device 5, for instance can be provided as shown in FIG. 2 with only two pulleys 11 and 12 which can be positioned with their upper circumference portion at the same level from the working table 4 of the sewing machine and interconnected by a flat driving belt 13. The rotation axes 11*a* and 12*a* of pulleys 12 and 13 are supported in a similar manner as pulleys 6 and 7 of the previously described embodiment with reference to FIG. 1. Said axes 11*a* and 12*a* are respectively mounted on supports 19 and 20 which can be fastened at variable positions on frame 21 of the apparatus by means, for instance, of fastening screws 22 and 23 each located into a slot formed in said supports 19 and 20. The axis of one of the pulleys, of course, could be positioned in such a manner to allow the adjustment of the stress of driving belt 13 as it happened for pulley 8 of the embodiment shown in FIG. 1. Analogously one of the pulleys 11, 12 is connected to rotating members of the sewing machine, thus being the driving pulley while the other pulley is the driven pulley and idle supported on its rotation axis. The driving belt 13, not only controls the forward feeding on the working table 4 of the two cloths to be jointly sewed, but has also the function of supporting said cloths during said forward movement, the arrangement being of course such that the operation of needle 2 is not hindered by said belt. As a matter of fact the two cloths are positioned in a staggered relationship relative to belt 13 and also in this case a positioning device (not shown in FIG. 2) can be provided near the sewing point, as the one previously indicated with reference numeral 14 and shown in detail in FIG. 7.

Figure 3:
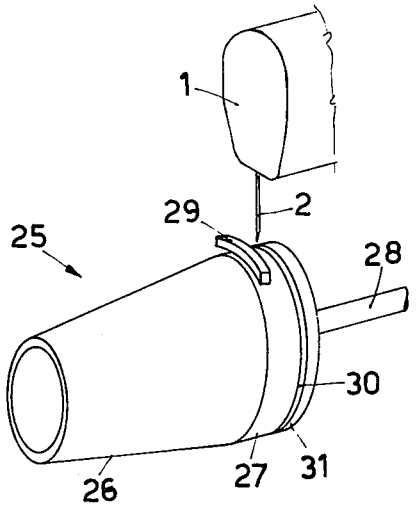

According to a further embodiment of the invention, the supporting and feeding means of the cloths to be jointly sewed may comprise, as diagrammatically shown in FIG. 3, a substantially funnel-shaped member 25 essentially formed by a truncated-cone shaped portion 26 with a substantially cylindrical portion 27 on its major base. The diameter of the cylindrical portion 27 must be such that the cloths can be positioned thereon with some stretch in order to be dragged into rotation by member 25 itself. Member 25, if desired, may be formed by a plurality of sections radially movable relative to the rotation axis 28 of the same member 25, so that the stretch of the cloths can be changed in order to make easier their insertion on member 25 and to adapt the apparatus to different circumferences of the annular edge of the less elastic cloth. The axis 28 is connected in any desired manner to the rotating members of the sewing machine.

The funnel-shaped member 25 is further provided on its cylindrical portion 27 with a clamping means 29 adapted to secure the cloths thereon. A groove 30 is provided along the circumference of portion 27, in order to allow the needle 2 to penetrate and to carry out the sewing. The cylindrical portion 27 is therefore divided into two sections, the outer section 31 being fixed to the inner section by means of pivots, U-bolts and the like (not shown).

Figure 4:
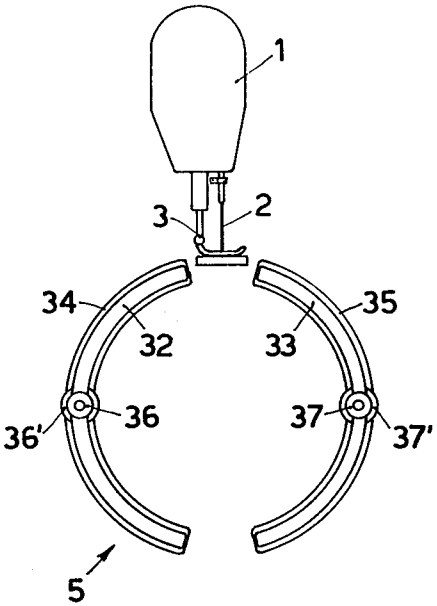

With reference to FIG. 4, a further embodiment of the supporting and feeding means of the cloth to be jointly sewed is shown. Said embodiment comprises a first pair of grippers 32, in a facing relationship, each comprising two jaws respectively rotatable around a central pivot 36 and 37. The two cloths to be sewed are positioned around said pair of opposite grippers 32, 33 when their jaws are in their closed position. Thereafter the jaws are opened to assume, for each gripper, the semicircle conformation shown in FIG. 4. If necessary, tensioning springs may be provided. Outwardly of said pair of grippers 32, 33, with respect to the sewing machine, a second pair of grippers 34, 35 is positioned, the fulcra 36' and 37' of which are respectively coaxial to fulcra 36 and 37 of the first pair. Grippers 34 and 35 overlap grippers 32 and 33 and are generally parallel thereto but they can be provided with a rotational movement around an axis perpendicular to fulcra 36' and 37', so that each jaw of grippers 34 and 35 may come into contact respectively with the corresponding jaw of grippers 32 and 33. The cloths positioned on grippers 32 and 33 are therefore retained on said grippers 32 and 33, other than by the action of said first pair of grippers, also by the retaining action of the second pair of grippers 34 and 35.

The cloth supporting and advancing means, in the embodiment above described and shown or in other possible embodiments, can be stationary or movable relative to the sewing head of the machine. Should said means be of the stationary type, in proximity of the sewing head 1 there will be assembled only one unit comprising three or two pulleys, or one funnel-shaped member, or the two pairs of grippers as respectively shown in FIGS. 1, 2, 3 and 4. In this case the operator may load and control several sewing heads, his task being only that of substituting on each sewing machine and at the end of each sewing cycle the finished piece with a new one, or only to load the two new cloths to be conjointly sewed should a discharging device of the finished pieces be provided.

Figure 6:
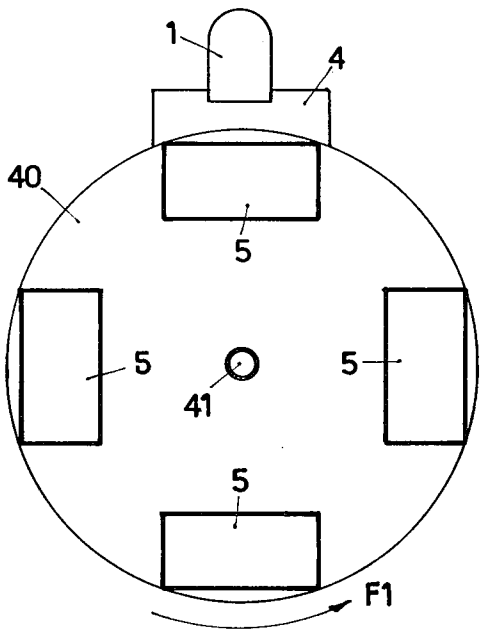
FIGS. 5 and 6 diagrammatically show two further embodiments of the apparatus according to the invention, respectively provided with two and four units of cloth supporting and feeding means.
Figure 5:
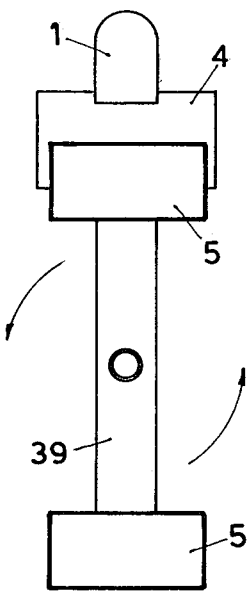

According to an advantageous aspect of the present invention the supporting and feeding means of the cloths are movable relative to the head 1 of the sewing machine. In FIGS. 5 and 6 are shown two preferred assembling solutions of the supporting and advancing means 5 movable relative to the sewing machine.

FIG. 5 schematically shows an example of assemblage in proximity of the sewing head 1, of two supporting and driving units 5 which are supported at the end of a transverse member 39 lying on a plane parallel to the working table 4 of the sewing machine. Each unit 5 may have any of the embodiments above described and shown. Transverse member 39 is connected to driving means (not shown) which cause said member to rotate of 180° at the end of each sewing cycle. This solution allows to reduce the working time, since while an operator loads one of the two units 5, the other unit undergoes this sewing cycle. If desired, more than two units controlled by the same operator can be provided in order to exploit at the maximum the working time of the sewing machine.

In FIG. 6 four supporting and feeding units 5 are shown arranged at 90° on a platform 40 step-by-step rotating around its central axis 41, each step being of 90°, and lying on a plane parallel to the working table 4 of the sewing machine. Also in this case units 5 may be any of the embodiments described and shown in FIGS. 1–4. With this arrangement the production time of the finished pieces is further reduced and the working time of the sewing machine practically fully utilized.

Of course, platforms 40 may be provided having assembled thereon a number $n$ of equally spaced apart units and the platform being step-by-step rotated $360°/n$ at the end of each sewing cycle.

Reverting now to the second type of sewing operation which can be performed by the apparatus according to the invention, i.e. sewing a linear length of an elastic band onto an elastic cloth having a lower elasticity and a substantially annular shape, it should be noted that the apparatus for obtaining said second type of sewing is substantially identical to the apparatus above described, in particular for what concerns the supporting and feeding means, the positioning means and the automatic discharging means of the finished pieces.

It is sufficient that to the sewing head of the machine is added only a conventional feeding device for the elastic band supplied by a roll, said feeding device usually comprising supporting means for the rolled-up elastic band, guiding means near the sewing head for said elastic band and cutting means for cutting same band into desired lengths according to the circumferential length of the cloth with lower elasticity.

The sewing operation of two cloths having different elasticity is carried out in the same way as in the case of a ring-shaped elastic cloth. The only difference stands in that at the end of the main sewing cycle the two extremities of each length of elastic band have to be sewed together to obtain a closed ring. For carrying out said sewing operation, two solutions are provided by the apparatus according to the present invention.

A first solution resides in that adjacent to the head of the main sewing machine an ancillary sewing machine is positioned, the head of which is adapted to sew together the ends of the length of elastic band. Said second sewing operation is carried out after the completion of the first main sewing operation by transferring, possibly in an automatic way, said two ends under the head of said ancillary machine. In alternative, it is possible to shift in any conventional manner the supporting and feeding means of the main sewing machine towards the sewing head of the ancillary machine, which allows to carry out the sewing of the two ends of the elastic band with the two already jointly sewed cloths still supported by the above described supporting and feeding means.

A second solution consists in that the sewing head of the main machine i.e. the one used for jointly sewing the two cloths, is modified in such a way that the same head can be moved transversely at 90° with respect to the path of the two cloths, at the end of the main sewing cycle, so as that the same machine which has sewed the two cloths can also sew the ends of the elastic band in a direction transversal to the length of the band. The modifications to be brought into the head of the sewing machine for this transverse movement are not therein disclosed since they are well known to the man skilled in the art.

From the above there are clearly apparent the advantages afforded by the apparatus according to the invention, which are:

1. reduction of the production times and full utilization of the working time;
2. possibility to entrust the work to non-specialized personnel;
3. constant quality of the finished pieces independently from the fact that said pieces have been manufactured by one operator or by different operators;
4. adaptability of the apparatus to any possible dimension or size of the pieces to be manufactured, particularly in connection with the different diameters of the circular outline of the less elastic cloth.

Possible modifications and/or additions can be obviously carried out in the above-described and illustrated apparatus without exceeding the scope of the present invention as defined by the appended claims.

What I claim is:

1. An automatic apparatus for conjointly sewing two elastic cloths having a different elasticity, the cloth with a lower elasticity having a substantially annular contour, the sewing of said cloths occurring through a sewing cycle defined by substantially 360° of said annular cloth of lower elasticity, said apparatus comprising a sewing machine having a working table and a rotating member, said sewing machine having a sewing area including a sewing needle, said apparatus further comprising supporting and feeding means for the cloths to be joined on the working table of the sewing machine, said supporting and feeding means comprising a plurality of pulleys, one of which is connected to said rotating member of the sewing machine, said pulleys each having a conical portion and a cylindrical portion operable to support said cloths in overlapping position to be sewn and being positioned in a plane which is perpendicular to the working table of the sewing machine, the axis of one of the pulleys not connected to the rotating member of the sewing machine being defined by a shaft adjustable in its position relative to the other pulleys whereby the center distance between said one pulley and the other pulleys is adjustable, said shaft being fastenable in any of its positions; positioning means for positioning said cloth within the sewing area; and discharging means for automatically discharging the finished pieces formed by the two joined cloths.

2. An apparatus as defined in claim 1, said positioning means including a pressure shoe supporting the cloth of higher elasticity adjacent the sewing area, said pressure shoe being movable in a first direction substantially perpendicular to the plane of the pulleys to position the cloth of higher elasticity in overlapping relation to the cloth of lower elasticity in the sewing area, said pressure shoe being retractable in a second direction opposite said first direction near the last 20-30° of said sewing cycle allowing said cloth of higher elasticity to rest directly on said cloth of lower elasticity in the sewing area and in overlapping relation therewith.

3. An apparatus as defined in claim 1, said pulleys each having a double coned, truncated surface and an adjacent cylindrical section separated from the coned surface by an annular groove, said cloth of higher elasticity being supported on said cylindrical section of said pulleys, said cloth of lower elasticity being supported on said coned section of said pulleys and maintained in adjacent relation to said cloth of higher elasticity by said coned section.

4. An automatic apparatus according to claim 1, wherein said supporting and feeding means is fixed substantially aligned with the head of the sewing machine.

5. An automatic apparatus according to claim 1, wherein said supporting and feeding means comprises *n* units, said units being rotatively positioned at 360°/*n* angles on a step-by-step rotating means, so that each of said *n* units is subsequently brought into a position substantially aligned to said head of the sewing machine at the end of each sewing cycle.

6. An automatic apparatus according to claim 1, wherein said supporting and feeding means comprises a funnel-shaped member connected to the rotating members of the sewing machine, said funnel-shaped member having a substantially truncated-cone shaped first portion and a cylindrically shaped second portion, said second portion being adapted to receive on its outer surfaces the two cloths to be jointly sewed and being provided with a peripheral groove for allowing the needle of the sewing machine to penetrate during the sewing cycle.

7. An automatic apparatus according to claim 1, wherein said positioning means for positioning the cloths within the sewing area comprises a stationary lower slider for the cloth of less elasticity and an upper movable pressure shoe for supporting the elastic cloth, said upper movable shoe being shiftable in two opposite directions perpendicular to the direction of advancement of the two cloths, means being provided for operating the backwards movement of said movable shoe at the beginning of the last 20-30° portion of the sewing cycle in order to free said elastic cloth during said last sewing portion, thus allowing said elastic cloth to rest on the other cloth of lower elasticity.

8. An automatic apparatus according to claim 7, wherein said positioning means for the cloths within the sewing area is positioned about 5–6 cms ahead of the needle of the sewing machine in the direction of forward feeding of the cloths.

9. An automatic apparatus according to claim 1, wherein said discharging means for automatically discharging the finished pieces comprises a pipe having at one end a funnel-shaped inlet positioned in the proximity of the head of the sewing machine, said pipe being kept under vacuum, by known suction means, the other end of said pipe being connected to a container provided with an openable bottom and of length at least equal to the larger dimensions of the two cloths to be jointly sewed, detecting means of the presence of the finished piece being provided at the inlet of said container to equalize the outside atmospheric pressure, conventional mechanical means for spreading the finished piece inside said container and means for opening bottom of the container as soon as the inside pressure of the container had equalized the outside one.

10. An automatic apparatus according to claim 1, wherein, when the more elastic cloth is a ribbon-shaped elongated band, said apparatus further comprises a second sewing head adapted to sew together the ends of said length of elastic cloth.

* * * * *